United States Patent [19]

Karlsson et al.

[11] Patent Number: 4,625,434

[45] Date of Patent: Dec. 2, 1986

[54] ARRANGEMENT IN CYLINDER DRYER

[75] Inventors: Ingemar Karlsson; Karl-Hugo Andersson, both of Växjö ; Rolf Petersson, Eneryda, all of Sweden

[73] Assignee: Flakt Aktiebolag, Nacka, Sweden

[21] Appl. No.: 473,447

[22] Filed: Mar. 9, 1983

[30] Foreign Application Priority Data

Mar. 25, 1982 [SE] Sweden ..... 8201904

[51] Int. Cl.[4] ..... F26B 13/08

[52] U.S. Cl. ..... 34/114; 34/116; 34/122; 34/123

[58] Field of Search ..... 34/54, 114, 116, 117, 34/122, 123

[56] References Cited

U.S. PATENT DOCUMENTS

| | | | |
|---|---|---|---|
| 3,250,019 | 5/1966 | Beachler | 34/117 |
| 3,337,968 | 8/1967 | Krikorian et al. | 34/116 |
| 4,172,007 | 10/1979 | Kankaanpaa | 34/117 |
| 4,416,070 | 11/1983 | Vedenpa et al. | 34/116 |
| 4,481,723 | 11/1984 | Vedenpaa | 34/114 |
| 4,516,330 | 5/1985 | Eskelinen et al. | 34/114 |

FOREIGN PATENT DOCUMENTS 59637 5/1981 Finland .

*Primary Examiner*—Albert J. Makay
*Assistant Examiner*—David W. Westphal
*Attorney, Agent, or Firm*—Dann, Dorfman, Herrell & Skillman

[57] ABSTRACT

The invention relates to an arrangement in cylinder drying, intended for incorporation in a paper machine and including a plurality of heated cylinders (1) arranged substantially parallel in two rows, about which the paper web (2) is taken serpentine during drying, whereat it is carried by an endless porous fourdrinier wire (3) which presses the web against the cylinder surfaces in one row of cylinders and lies between the paper web and the cylinders in the other row. For preventing the web from lifting from the wire as a result of pressure differences on either side thereof, there are blowing boxes (11,12) arranged for blowing out air in at least some of the pockets (4,5) situated on opposite sides of the web, each of said pockets being formed by the web and three cylinders lying consecutively in the travelling direction of the web. Blowing out from the blowing boxes takes place in directions such that a sub-pressure is generated in the pockets (4) where the wire (3) lies outmost towards the pocket, and an excess pressure generated in the pockets (5) where the paper web (2) lies outmost towards the pocket.

7 Claims, 4 Drawing Figures

ARRANGEMENT IN CYLINDER DRYER

Figure 1:
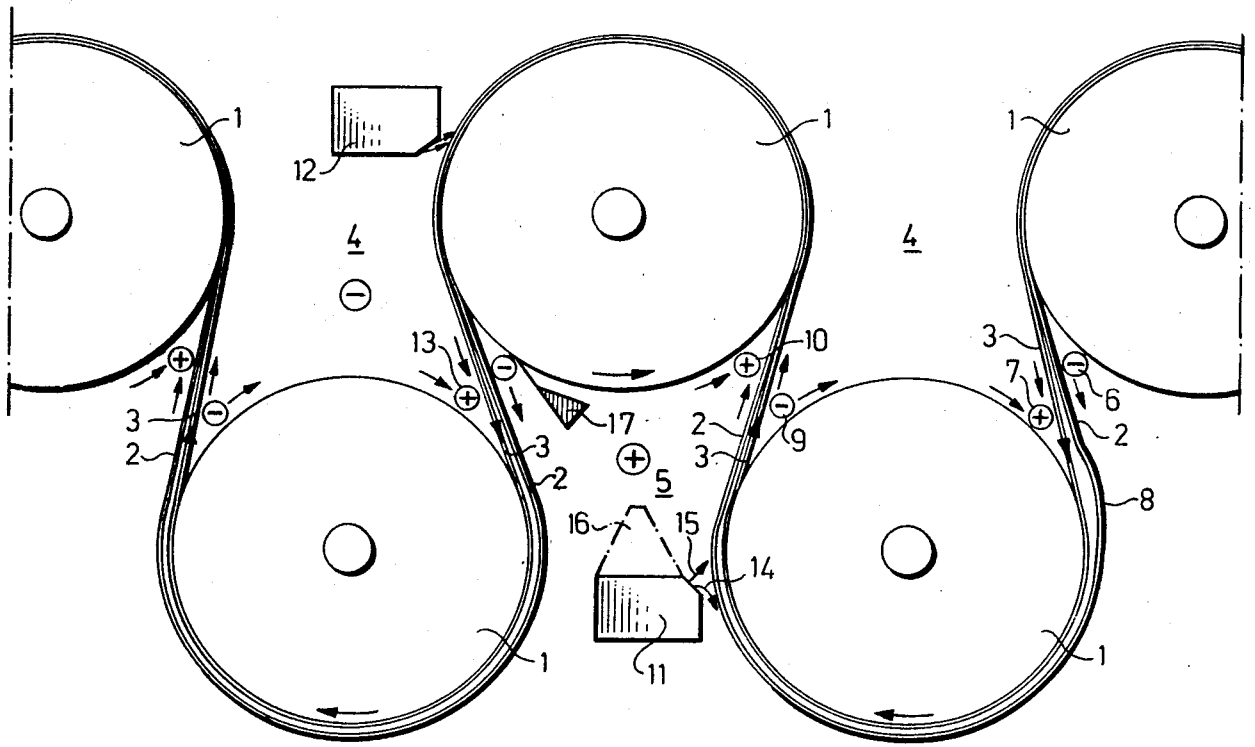

The present invention relates to an arrangement in cylinder drier intended to be part of a paper machine and including a plurality of heated cylinders in two substantially parallel rows, about which the paper web is taken in a serpentine path during drying, while being carried by an endless porous fourdrinier wire, the latter being adapted to press the paper web against the cylinder surfaces in one row of cylinders and being situated between the paper web and the cylinder surfaces in the other row, there being means provided to prevent the paper web from lifting from the wire due to pressure differences on either side of the web when it is taken between the cylinders.

It is well known that in the drying section of a paper machine with the wire running in a serpentine fashion that there are problems in training the web due to the web riding on a cushion of air when it lies on the wire which is then between the paper web and the cylinder surface. This phenomenon is associated with the wire entraining a boundary layer of air. An excess pressure occurs in the region where the wire and web come onto a cylinder, whereas there is a sub-pressure on the opposite side of the web in the region where it relinquishes contact with the previous cylinder. As the web acts as an airtight diaphragm in the region between the cylinders, while the wire allows a certain passage of air, the web will relinquish contact with the wire due to the pressure difference on either side of the web, and a blister occurs which can result in rupture or the formation of folds in the paper web.

In order to prevent the occurance of this blister there have been proposed certain solutions, e.g. of the kind apparent from the Finnish Patent Specification 59.637, where a solution to the problem has been attempted by placing suction means in the region where an excess pressure is formed when the web comes against a cylinder. However, this construction is complicated and expensive as well as energy-demanding. Another drawback of the known apparatus is that it does not actively contribute to drying the web in spite of its demand on energy. In the region between the serpentine wire section and the drying section with normal wire training over end rolls there is a tendency for the web to rupture, and with the ever-increasing web speeds demanded in modern paper machines it has been found necessary to extend the serpentine wire section so that the web will get sufficient strength before it goes over in the normal part of the drying section. It has been found necessary to improve drying in the serpentine wire section so that the drier as a whole will not need to be extended.

The object of the present invention is to prevent the occurrence of blisters which can cause rupture to and folds in the web, and also to allow improved drying in the serpentine wire section so that an extension of the total drier length may be avoided.

These objects are achieved, in accordance with the invention, substantially in that means for preventing blister formation are arranged for blowing out air into at least some of the pockets situated on opposite sides of the web, each of which being formed by the web and three consecutive cylinders in the conveying direction of the web. Blowing out from the blowing boxes takes place in such directions as generate a sub-pressure in the pockets where the wire faces towards the pocket, and an excess pressure in the pockets where the web faces towards the pocket.

Figure 2:
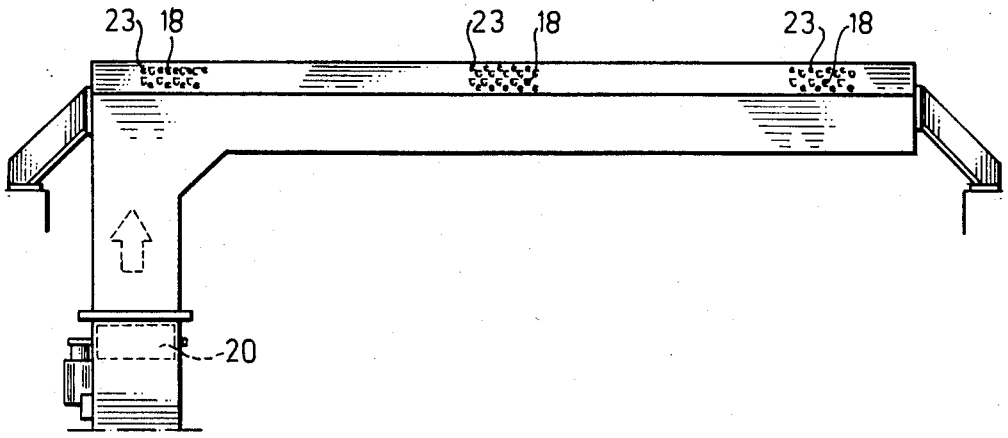
Figure 3:
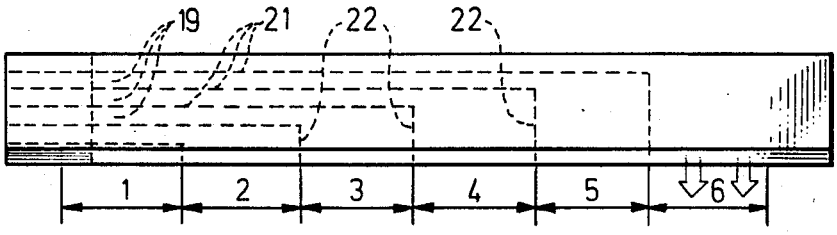
Figure 4:
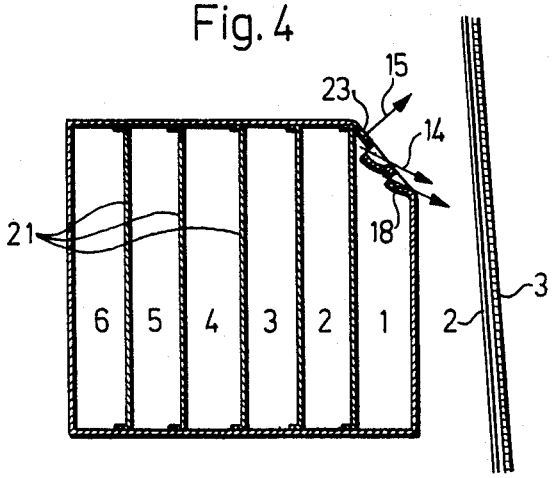

Some embodiments of the invention, selected as examples, will now be described in detail with reference to the accompanying drawings on which FIG. 1 is a side view of a portion of the serpentine wire section in a paper machine, with blowing boxes in two of the pockets, FIG. 2 illustrates a lower blowing box according to FIG. 1, seen from the front, FIG. 3 illustrates the blowing box according to FIG. 2 seen from above, with the subdivision of the blowing box in compartments indicated with the aid of dashed lines, and FIG. 4 is a cross section through the blowing box, in FIG. 2.

A portion of a serpentine wire section in a cylinder drier is apparent from FIG. 1, and includes a plurality of heated cylinders 1 arranged in two parallel rows displaced in relation to each other by half the spacing of the cylinders. The cylinders carry a paper web 2, which, due to the mutual displacement between the upper and lower cylinder rows, is led in a serpentine path during drying. The web is accordingly carried by an endless porous wire 3 to form a 2 ply assembly having a web face and an opposite face. The assembly is adapted to press the web face 2 against the cylinders 1 in the upper row while the wire face 3 is situated between the web 2 and the cylinder surfaces in the lower row. First cylinder pockets 5 are thus formed which are defined on the sides by the web face 2 as well as the upper cylinder and second pockets 4 defined on the sides by the wire face 3 and at the bottom by the lower cylinder, the pockets lying consecutively in the conveying direction of the web. When the wire 3 and web 2 relinquish contact with a cylinder surface or make contact with another cylinder surface, a sub-pressure or an excess pressure occurs locally in these regions. These pressures are caused by the movement of the web entraining a boundary layer of air in its conveying direction, as well as air which is entrained by the cylinder rotation. Where the web 2 relinquishes contact with the upper cylinder there is thus a sub-pressure 6, whereas an excess pressure 7 occurs where the web comes onto the lower cylinder. Since the wire 3 is porous, whereas the web is airtight in comparison therewith, the web will function as a diaphragm, and the web will form a blister 8 on the outside of the wire 3 due to the excess pressure 7 in the lower nip. The size of this blister formation depends on several different factors, among others the web speed, wire permeability and web density. Blistering is naturally reinforced by the sub-pressure 6 in the upper nip formed on the outside of the web, where the web leaves the upper cylinder. In a corresponding way there is a sub-pressure 9 in the web where the wire 3 relinquishes contact with the lower cylinder, and an excess pressure 10 where the web comes onto the upper cylinder. These pressure differences do not give rise to any blister formation, however, since the pressure difference acts in a direction pressing the paper web 2 against the wire 3.

In the part of the serpentine wire section illustrated in FIG. 1 there is an upper blowing box 12 arranged in one of the upper or second pocket 4, while a lower blowing box 11 is arranged in one of the lower or first pockets 5. The purpose of the lower blowing box 11 is to generate an excess pressure in the first pocket 5, thereby to prevent a blister when the paper web relinquishes contact with the upper cylinder and comes onto the lower cylinder, as described above. If the excess pressure in the first pocket 5 is adjusted so that it becomes at least as great as the excess pressure 13 in the lower nip, there occurs either a higher pressure in the first pocket 5 which counteracts the tendency of the web 2 to leave the wire 3, or practically no pressure difference at all across the web. The previously described blister formation is counteracted in both these cases, and the risk of web rupture due to it has thereby been eliminated. In order to amplify the effect of the lower blowing box 11, however, and reduce the excess pressure formed in the lower nip when the web comes onto the lower cylinder, a further blowing box 12 is arranged in the upper or second pocket 4 for blowing air out at an angle to the conveying direction of the web, thereby to destroy the boundary layer of air accompanying the wire. Thus, there occurs a sub-pressure in the upper pocket 4 for actively contributing to keeping the web 2 in engagement against the wire 3.

The blowing box 11 in the lower cylinder pocket is formed with sets of blowing orifices directed at an acute angle to the web travel outwardly from the pocket and sets of orifices blowing inwardly towards the pocket, suitably towards the web and in its direction of travel. The air streams 14 directed towards the web travel prevent the boundary layer of moist air above the periphery of the cylinder from being introduced into the lower cylinder pocket 5. The excess pressure in the pocket is generated with the first aid of air streams 15 directed in the web travelling direction and to the interior of the pocket. In another suitable embodiment, the blowing box 11 is formed with an extended portion 16, from which drying air is blown directly into the first pocket to generate the desired excess pressure. A doctor blade 17 is conventionally arranged at the periphery of the upper cylinder adjacent the region where the web relinquishes contact with the cylinder.

Serpentine training of the wire is utilized in a paper machine in the first part of the drying section for carrying the web where it is weakest, and thus in need of support. There accordingly occurs a critical rupture zone at the boundary between the serpentine wire section and the part of the drier where there is normal wire training, i.e. where the wire passes over guide rolls and the paper web is not supported during a portion of the web path. Up to now, the web has been allowed to pass over heated cylinders in the serpentine wire section to improve the strength properties of the web, while drying it has mainly taken place in the latter path of the drying section. In modern paper machines where high web speeds are demanded, there thus occurs the problem of being able to dry the web sufficiently during its passage through the drier. To avoid an extension of the drier it has therefore been the policy to already begin drying in the serpentine wire section. Further to the abovementioned function of providing reliable engagement of the web 2 against the wire 3, the blowing boxes 11 and 12 are also intended to ventilate the cylinder pockets, thereby to achieve drying of the paper web in the serpentine wire section. A further purpose of the blowing boxes in accordance with the invention is thus to improve drying in this section for obtaining a more durable paper web before it goes over to the drying section with conventional wire training.

In accordance with the invention, both blowing boxes 11 and 12 are suitably compartmentalized to form blowing sections along in the transverse direction of the web 2 to enable varied blowing along the web width and regulation of its drying profile.

The structure of the lower blowing box 11 will be seen from FIGS. 2, 3 and 4. The blowing box 11 thus has a substantially rectangular cross section with a bevelled-off edge portion in which there are made eye-lid perforations 18. The box is further divided into six sections, numbered in running order from 1 to 6. Drying air is individually supplied to these sections via compartments or channels 19, each containing an adjustable damper 20, with the aid of which the airflow to the different sections can be regulated individually to obtain the desired drying profile in the web. As will be apparent from the cross section in FIG. 4, the different sections are formed with the aid of partition walls 21 extending in the longitudinal direction of the blowing box up to end walls 22, dividing the box into sections. Further to the eye-lid perforations 18 there are also round perforations 23 in the lower blowing box 11, through which drying air flows out in the direction denoted by the numeral 15. The eye-lid perforations 18 are formed such that the air flowing out has a direction 14 practically parallel to the perforated wall of the box. The eye-lid perforations 18 are accordingly directed such that the blow onto the web takes place in a direction counter to that of the wire travel, while the round blowing apertures 23 give rise to air currents with a direction 15 having a component in the travelling direction of the web. Blowing onto the web takes place along the whole of its width and the airflow through the individual sections may, as mentioned before, be regulated with the aid of the dampers 20.

As previously indicated, the blowing box 11 can be formed with special means 16 for blowing air into the lower pocket. What is essential is that the air streams are directed such that an excess pressure is created in the first or lower pocket 5. Naturally, the blowing box 11 may be designed in a number of different embodiments to achieve the desired technical effect. Accordingly, it can also be conceived as having substantially circular cross section with perforations providing air streams perpendicular to the perforated surface. What is essential is that the exit perforations give rise to air currents directed in the manner denoted by the numeral 14, i.e. at an acute angle and counter to the travelling direction of the web. Remaining perforations must be directed towards the interior of the first pocket to achieve the desired excess pressure there. A condition for the location of the blowing boxes is that they shall be at a distance from the web such that for a web rupture there is a minimum risk of fouling. The alternative embodiment of the lower blowing box with a circular cross section has the advantage that it takes less room than the blowing box described in conjunction with FIGS. 1–4.

We claim:

1. Arrangement in a cylinder drier intended for incorporation in a paper machine and including a plurality of cylinders arranged in two substantially parallel rows, the paper web being trained serpentine about said cylinders during drying, said web being carried by a single endless porous fourdrinier wire to provide a two-ply assembly with an exposed web face and an exposed wire face, said assembly pressing the exposed web face radially inward against the cylinder surfaces in one row of cylinders and positioning the wire between the web and the cylinder surfaces in the other row with the exposed wire face directed radially inward, a series of pockets being formed by the web and the cylinders lying consecutive in the travelling direction of the web, at least one first pocket having sides defined by the exposed web face and a bottom defined by a cylinder of said one row, and at least one second pocket having sides defined by the exposed wire face and a bottom defined by a cylinder of said other row, said cylinder rows being spaced so that said assembly passes in a run from contact with one of said consecutive cylinders to contact with the next of said consecutive cylinders, in said run the web face facing a first pocket and the wire face facing a second pocket;

to prevent the paper web from lifting from the wire when it travels in said run between the cylinders, means being provided for blowing air into said first pocket, such that excess pressure is generated in the first pocket to counteract the negative pressure produced by the assembly passing out of contact with said one of said cylinders, and means being provided in said second pocket for blowing air obliquely against the wire toward its direction of travel when the wire is moving into the second pocket to generate a sub-pressure in the pocket to counteract the excess pressure produced by the assembly passing into contact with said next of said cylinders, thereby substantially eliminating the pressure difference across the assembly in the nip where the web and the wire pass into contact with said next of said cylinders, said blowing means in said second pocket being aligned with and confronting a cylinder so that it blows against the wire at a point where the two-ply assembly is engaged on the cylinder.

2. Arrangement as claimed in claim 1, characterized in that the means for blowing air into the first pocket comprises a blowing box aligned with the said other row adjacent the web face at the entrance of the first pocket, said box being provided with blowing orifices directed inwards towards the first pocket.

3. Arrangement as claimed in claim 2, characterized in that the blowing box is provided with additional blowing orifices directed at an acute angle to the exposed web surface of the two-ply assembly, and outwards from the first pocket.

4. Arrangement as claimed in claim 2, characterized in that the blowing box is compartmentalized in the transverse direction of the web to enable varied blowing out along the web width and regulation of its drying profile.

5. Arrangement as claimed in claim 1, characterized in that the means for blowing air obliquely against the wire moving into the second pocket comprise a blowing box aligned with said one row adjacent the exposed wire face at the entrance of the second pocket, said box being provided with blowing orifices directed at an acute angle towards the direction of web travel and outward from the second pocket.

6. Arrangement as claimed in claim 5, characterized in that the blowing box is compartmentalized in the transverse direction of the web to enable varied blowing out along the web width and regulation of its drying profile.

7. Arrangement in a cylinder drier intended for incorporation in a paper machine and including a plurality of cylinders arranged in two substantially parallel rows, the paper web being trained serpentine about said cylinders during drying, said web being carried by a single endless porous fourdrinier wire to provide a two-ply assembly with an exposed web face and an exposed wire face, said assembly pressing the exposed web face radially inward against the cylinder surfaces in one row of cylinders and positioning the wire between the web and the cylinder surfaces in the other row with the exposed wire face directed radially inward, a series of pockets being formed by the web and the cylinders lying consecutive in the travelling direction of the web, at least one first pocket having sides defined by the exposed web face and a bottom defined by a cylinder of said one row, and at least one second pocket having sides defined by the exposed wire face and a bottom defined by a cylinder of said other row, said cylinder rows being spaced so that said assembly passes in a run from contact with one of said consecutive cylinders to contact with the next of said consecutive cylinders, in said run the web face facing a first pocket and the wire face facing a second pocket;

to prevent the paper web from lifting from the wire when it travels in said run between the cylinders, a first means being provided to generate excess pressure in the first pocket to counteract the negative pressure produced by the assembly passing out of contact with said one of said cylinders, and a second means being provided in said second pocket to generate a sub-pressure in the second pocket to counteract the excess pressure produced by the assembly passing into contact with said next of said cylinders, thereby substantially eliminating the pressure difference across the assembly in the nip where the web and the wire pass into contact with said next of said cylinders, said first means comprising a blowing box in said first pocket having first orifices directed to blow air into said pocket, and additional orifices at the entrance of said pocket so that it blows air at an acute angle against the web outwards from said first pocket.

* * * * *

UNITED STATES PATENT AND TRADEMARK OFFICE

CERTIFICATE OF CORRECTION

PATENT NO. : 4,625,434

DATED : December 2, 1986

INVENTOR(S) : Ingemar Karlsson; Karl-Hugo Andersson; Rolf Petersson

It is certified that error appears in the above-identified patent and that said Letters Patent is hereby corrected as shown below:

Column 1, line 34, "occurance" should be --occurrence--;

Column 2, line 26, after "opposite" insert --wire--;

Column 3, line 50, "path" should be --part--.

Signed and Sealed this

Twenty-first Day of April, 1987

*Attest:*

*Attesting Officer*

DONALD J. QUIGG

*Commissioner of Patents and Trademarks*